United States Patent [19]

Kern

[11] 4,026,492

[45] May 31, 1977

[54] RIBBON TENSION CONTROL MEANS

[75] Inventor: Jack L. Kern, Arlington, Tex.

[73] Assignee: Xerox Corporation, Stamford, Conn.

[22] Filed: Sept. 29, 1975

[21] Appl. No.: 617,559

[52] U.S. Cl. ..... 242/75.2

[51] Int. Cl.[2] ..... B65H 23/10

[58] Field of Search ..... 242/75.2, 75.3, 75.43, 242/156.2; 226/39, 195; 197/151

[56] References Cited

UNITED STATES PATENTS

| | | | |
|---|---|---|---|
| 2,696,192 | 12/1954 | Birchler | 242/75.43 X |
| 2,838,250 | 6/1958 | Starrakis | 242/75.2 X |
| 3,380,680 | 4/1968 | Dunsheath | 242/75.43 X |
| 3,412,192 | 11/1968 | Clapson | 242/75.2 X |

*Primary Examiner*—Edward J. McCarthy

[57] ABSTRACT

A ribbon tension control means comprising a frictional drag means in frictional contact with the side surface of the ribbon. The frictional drag means is positioned at a location along the path of travel of the ribbon after the ribbon departs from the supply spool. The ribbon tension control means includes guide means for maintaining a substantially constant angle of contact between the frictional drag means and the side surface of the ribbon.

6 Claims, 4 Drawing Figures

RIBBON TENSION CONTROL MEANS

BACKGROUND OF THE INVENTION

This invention relates in general to web tension-control apparatus and more particularly to tension-control apparatus for ink ribbons employed in serial printer applications.

Although the invention is applicable to various web, tape, strand and ribbon-like materials, it has been found particularly useful in the environment of ink ribbons as used in serial printers. Therefore, without limiting the meaning of the word "ribbon," the invention will be described in this environment.

In devices in which any web material is to be delivered or transferred from a rotatable reel, drum, spool, spindle or a like receptacle to another similar and compatible receptacle, it is normally necessary to provide means for maintaining a certain amount of tension in the web material during its deliverence. In the particular environment of ink ribbons employed in serial printers, a certain amount of tension is required for proper ribbon feed and acceptable print quality of the printed material.

As any web material is delivered between a pair of reels, drums, spools, spindles, etc., the tension therein will tend to vary due to geometrical and inertial changes. In a serial printer ribbon system, a certain amount of variation in the tension in the ribbon does not adversely affect the ribbon feed or the print quality; however, it is necessary to maintain an acceptable tension on the ribbon in order to ensure that the ribbon is taut at the printing position or station. In addition, the ribbon must be maintained under tension in order to wrap the ribbon on the take-up spool in a tight and even manner.

A fabric ribbon is less susceptible to changes in tension than the matrix type plastic ribbon since it does not stretch nor break as easily, and it more easily conforms to the physical shape of the character during the printing action. When using a matrix type plastic ribbon, an excessive amount of tension in the ribbon can cause the ribbon to stretch and wrinkle and/or fold over onto itself about the deformed center portion or to break, all of which affect the print quality. Also, an excessively low ribbon tension can allow the ribbon to move from its print position to a degree, which causes partial or total loss of printing of characters.

It is well known in the art to continuously vary the braking of the wind-off reel in dependence of the tension in the wound-off web material and to rapidly stop and wind-off reel in case of disruption of the web material as disclosed in U.S. Pat. No. 3,243,137. It is also known to use a pawl and ratchet brake device as disclosed in U.S. Pat. No. 3,442,366 to control ribbon tension in an incrementing ribbon feed system. In U.S. Pat. No. 3,621,968, a roller and spring arrangement is disclosed to provide tension in an endless ribbon within a ribbon cartridge. The present assignee is marketing an electronic typing system under the tradename of Xerox 800 Electronic Typing System, which employs a spring and dancer-arm arrangement, as shown in FIG. 1, to provide the necessary control of tension in the matrix type plastic ribbon.

Such prior art solutions have utilized moving mechanical means to provide the necessary control of the tension in the web material.

With the prior art in mind, it is an object of the present invention to maintain the tension in a ribbon-like member substantially uniform during its transfer from a supply spool to a take-up spool.

Another object of this invention is to provide a cost effective means to maintain the tension in ink ribbons contained in cartridges along the presently described vane.

Yet, another object of the present invention is to provide a simple and reliable ribbon tension control means, which is compatible with cartridges of the present type.

Other objects and advantages of this invention will be evident from the specification and claims and the accompanying drawing illustrative of the invention.

SUMMARY OF THE INVENTION

In accordance with principles illustrative of this invention, the foregoing objects and others of the present invention are accomplished by a frictional drag means in frictional contact with the side surface of the ribbon, said frictional drag means being positioned at a location along the path of travel of the ribbon after the ribbon departs from the supply spool. The frictional means comprises a rectangular bar or beam whose end area is in frictional contact with the side surface of the ribbon. The tension in the ribbon depends upon the frictional force of each incremental area of the end of the rectangular bar or beam in contact with the side surface of the ribbon. The frictional surface of the frictional drag means, which bears on the side surface of the ribbon material, can be any material which has an approximately constant coefficient of friction. Preferred materials are of felted or fibrous structure since experience has shown that this structure tends to minimize the difference between static and sliding friction. A cellular or sponge-like material will have similar properties. The mounting means for the frictional drag means comprises two spaced-apart rod-like members, projecting upward from the inside bottom surface of the ribbon cartridge, cooperating with two corresponding holes in the frictional drag means. In the preferred embodiment, a single rod-like member, projecting upward from the inside bottom surface of the ribbon cartridge, is located at a point between the frictional drag means and the point of departure of the ribbon from the supply spool such that the angle of contact between the frictional drag means and the ribbon remains substantially constant from the conditions of a full supply spool to an empty supply spool.

BRIEF DESCRIPTION OF THE DRAWING

Other advantages and features of the present invention may become more apparent from reading the following detailed description in connection with the drawing forming a part thereof, in which.

DESCRIPTION OF THE PREFERRED EMBODIMENT

Figure 1:
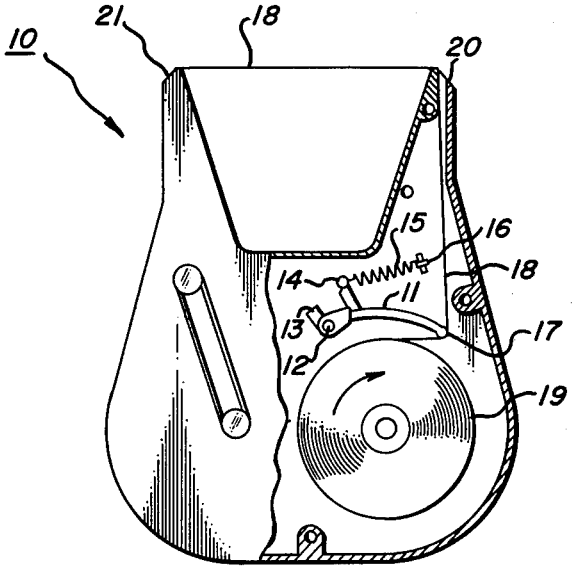
PRIOR ART FIG. 1
FIG. 1 is a fragmentary top plan view showing a ribbon cartridge constructed in accordance with the prior art.

The prior art ribbon tension control means employed in the ribbon cartridge 10 of FIG. 1 consists of an arm 11 coupled for pivotal movement at one end by pin 12 in conjunction with post 13. Post 13 is secured to the bottom portion of ribbon cartridge 10 and extends upward therefrom. Extending approximately at right angles from the side of arm 11, located furthest from ribbon supply spool 19 and being integral with arm 11, is lever 14. Post 16 is secured to the bottom portion of ribbon cartridge 10 with spring 15 fastened between post 16 and lever 14 in a manner, which forces the outer end of arm 11 clockwise toward the ribbon supply spool 19. Arm 11 is molded out of a plastic material, such as acetal or "DELRIN" resins.

Regarding ribbon path, the ribbon 18 passes from the ribbon supply spool 19 to the end of arm 11 opposite pin 12 where the ribbon then passes between two ear-like extensions 17 (one extension located on each of the upper and lower edges of arm 11). The two ear-like extensions 17 act as guides to maintain the ribbon in contact with the end of arm 11 and not allow it to fall off the end of arm 11 and thereby lose tension or become jammed between an edge of arm 11 and the top or bottom cover portions of ribbon cartridge 10. After passing around the end of arm 11, ribbon 18 passes out of ribbon cartridge 10 through an opening in horn 20, across the open space between horns 20 and 21 and then into an opening in horn 21 to the ribbon drive means (not shown) and the ribbon take-up means (not shown) located in the left-side portion of ribbon cartridge 10.

In operation, the ribbon drive means intermittently pulls the ribbon 18 from the ribbon supply spool 19 thereby providing a fresh portion of ribbon 18 at the print station (located approximately midway between horns 20 and 21) for the printing operation. As the ribbon 18 is being intermittently pulled from the ribbon supply spool 19, frictional forces between the ribbon 18 and the end of arm 11, in contact with the ribbon 18, cause arm 11 to pivot in a counterclockwise direction. This pivoting of arm 11 in a counterclockwise direction continues during the advancement of the ribbon 18 until the opposing force at the end of arm 11 in contact with the ribbon 18, which opposing force is due to the action of spring 15 attempting to cause arm 11 to pivot in a clockwise direction, exceeds the force of friction between the ribbon 18 and the end of arm 11 in contact with the ribbon 18. When the opposing force exceeds the force of friction, the end of arm 11 in contact with the ribbon 18 will slide along the ribbon 18 in a clockwise direction until the force of friction equals the opposing force, at which time the end of arm 11 in contact with the ribbon 18 will stop its movement with respect to ribbon 18. As the ribbon 18 continues to be fed from the ribbon supply spool 19, the end of arm 11 in contact with the ribbon 18 will again move or pivot in a counterclockwise direction with the ribbon 18. This movement will continue until the opposing force exceeds the force of friction between the ribbon 18 and the end of arm 11 in contact with the ribbon and then the previously described cycle is repeated.

As arm 11 moves throughout its clockwise and counterclockwise movement, the angle of contact of the ribbon 18 with the end of arm 11 varies; also, the amount of wrap-around (the length of ribbon 18, which is in contact with the end of arm 11) varies as arm 11 moves. In addition, the angle of contact and the amount of wrap-around varies from when the ribbon 18 is being removed from a full ribbon supply spool 19 and when the ribbon is being removed from a nearly empty ribbon supply spool.

During the normal printing of a multiplicity of characters, the end of arm 11 will move or "dance" back and forth in a clockwise and counterclockwise direction as the ribbon advances. The distance the end of arm 11 moves and the speed and frequency with which it moves is dependent upon such variables as the speed of ribbon movement (related to printing speed), the amount of force pulling the ribbon 18 from the ribbon supply spool 19, the amount of frictional forces encountered by the ribbon 18 throughout its path from the ribbon supply spool 19 to the ribbon take-up spool (not shown), the surface irregularities of ribbon 18, etc. The force exerted on the ribbon 18 by the end of arm 11 together with the force exerted on the ribbon 18 by the end of arm 11 together with the force exerted on the ribbon 18 by the ribbon drive means primarily determines the tension in the ribbon 18. By judicious choosing of the length of arm 11, the spring 15, the ribbon drive means, etc., an acceptable range of tension values in the ribbon 18 may be provided. Although the tension in the ribbon 18 may vary slightly during the printing operation, it normally varies within acceptable limits. In addition, if slack occurs in the portion of the ribbon 18 located at the print station between horns 20 and 21 (because of some external force, the printhead, etc.), spring 15 will cause arm 11 to pivot clockwise, remove the slack and maintain an acceptable tension value in the ribbon.

Although the above-described prior art ribbon tension control means operates satisfactorily, it is relatively complicated and expensive. It is complicated from the viewpoint of consisting of numerous small parts, which must be individually fabricated and then be assembled by hand in the ribbon cartridge 10. It is expensive because of the number of parts involved and because of the time in labor involved in assembling the numerous parts in the ribbon cartridge 10 by hand rather than by machine.

Figure 2:
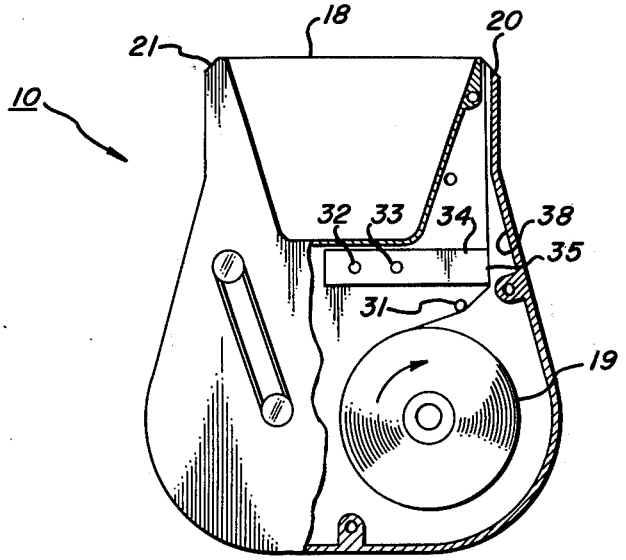
FIG. 2 is a fragmentary top plan view showing a ribbon cartridge constructed in accordance with the teachings of the present invention.
Figure 3:
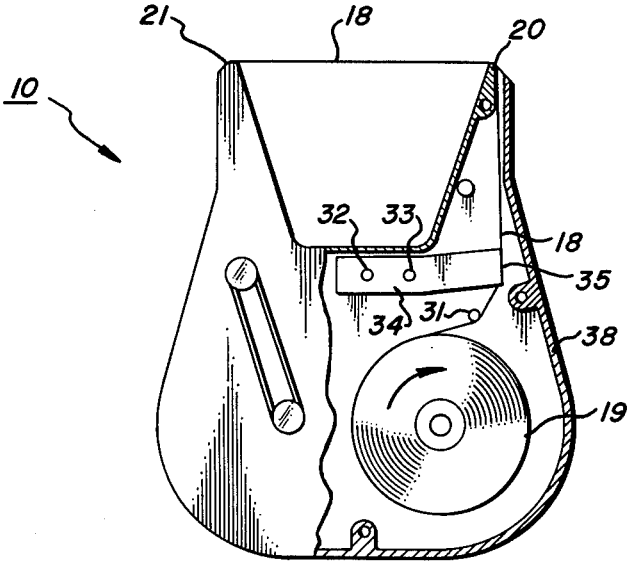
FIG. 3 is a fragmentary top plan view similar to FIG. 2 showing the friction drag means in a folded position.
Figure 4:
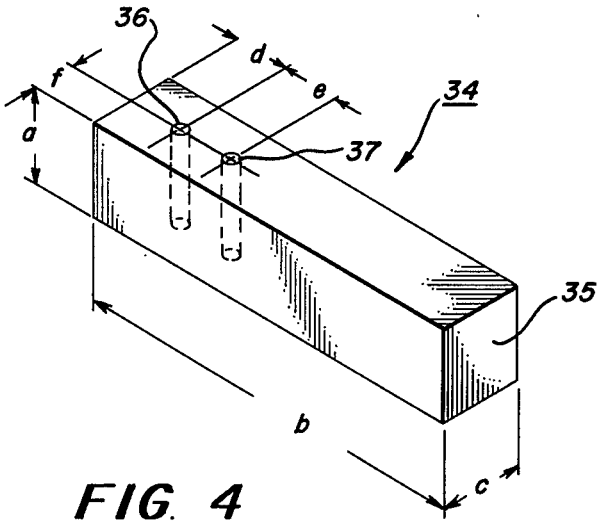
FIG. 4 is a perspective view of a frictional drag means according to the invention.

FIGS. 2–4 represent a solution according to the instant invention, which provides for the elimination of the disadvantages set forth supra.

Referring now to FIG. 2, there is shown one embodiment of the ribbon tension control means of the present invention in the ribbon cartridge 10. Frictional drag means 34 is positioned such that the end 35 is in frictional contact with the side surface of the ribbon 18 after the ribbon departs from the ribbon supply spool 19. Frictional drag means 34 is in the form of a rectangular bar or beam with two spaced-apart holes 36 and 37 through the bar, located toward one end thereof. Two posts 32 and 33, which project upward from the bottom portion of the ribbon cartridge 10 are of a size and position such as to mate with and protrude through holes 36 and 37 of frictional drag means 34 and provide the mounting means for the frictional drag means. The posts or projections 32 and 33 are of such a size as to be smaller than and fit loosely into holes 36 and 37 whereby a very slight pressure or force places the frictional drag means 34 into position down over projections 32 and 33.

A guide post 31, which projects upward from the bottom portion of the ribbon cartridge 10, is positioned between the end 35 of the frictional drag means 34 and the ribbon supply spool 19. The post 31 is positioned at a location such that the angle of contact between the frictional drag means 34 and the ribbon 18 remains substantially constant from the conditions of a full ribbon supply spool 19 to an empty ribbon supply spool.

With regard to the path of the ribbon 18, ribbon 18 passes from the ribbon supply spool 19, around and to the right (outboard) of post 31 and then across the end 35 of the frictional drag means 34. After passing across the end 35 of the frictional drag means 34, the ribbon 18 passes out of ribbon cartridge 10 through an opening in horn 20, across the open space between horns 20 and 21 and then into an opening in horn 21 to the ribbon drive means (not shown) and the ribbon take-up means (not shown) located in the left-side portion of ribbon cartridge 10.

In operation, the ribbon drive means intermittently pulls the ribbon 18 from the ribbon supply spool 19 thereby providing a fresh portion of ribbon 18 at the print station (located approximately midway between horns 20 and 22) for the printing operation. As the ribbon 18 is being intermittently pulled from the ribbon supply spool 19, frictional forces between the ribbon 18 and each incremental area of the end 35 of the frictional drag means 34 cause the end 35 of the frictional drag means 34 to move upward with the ribbon 18 as shown in FIG. 3. The end 35 of the frictional drag means 34 will continue to move upward in contact with the ribbon 18 until the restoring force (resulting from the elasticity of the material comprising drag means 34) within the frictional drag means 34, caused by the bending or distorting of the frictional drag means, exceeds the frictional forces between the ribbon 18 and the end 35 of the frictional drag means 34. At the time of this occurrence, the end 35 of the frictional drag means 34 will cease its movement with the ribbon 18, and the ribbon 18 will slide on the surface of end 35. A very slight movement of the end 35 may occur because of the intermittent pulling of the ribbon 18, the surface irregularities of the ribbon 18, etc.

Normally, during printing operations, the frictional drag means 34 will remain in the position shown in FIG. 3. The upper and lower edges of the end 35 of the frictional drag means 34 will tend to cup around the ribbon and maintain the ribbon essentially in the center portion of end 35 as the ribbon moves past end 35. If slack occurs in the portion of the ribbon 18 located at the print station between horns 20 and 21 (because of some external force, the printhead, etc.), the end 35 of the frictional drag means 34 will move in a clockwise or downward movement (because of the elasticity of the material) thereby removing the slack and maintaining an acceptable tension value in the ribbon 18.

Preferred materials for the frictional drag means 34 are of felted or fibrous structure since experience has shown that this structure tends to minimize the difference between static and sliding friction. A cellular or sponge-like material will have similar properties. In the preferred embodiment, the material for the frictional drag means 34 is Scott Custom Polyester Urethane Flexible Foam, 90 percent open cell and 4 lb./cu.ft.

The shape of the preferred embodiment of the frictional drag means 34 as used in the ribbon cartridge 10 of FIG. 2 is shown in FIG. 4 and comprises a rectangular bar or beam whose length (*b*) is approximately 1.88 inches, whose height (*a*) is approximately 0.38 inches and whose width (*c*) is approximately 0.50 inches. Two holes 36 and 37 of an approximate diameter of 0.13 inches have a centerline spacing (*e*) (between the two holes) of approximately 0.38 inches. Hole 36 is located approximately 0.38 inches from the end of the frictional drag means 34 as shown by dimension (*d*). The thickness or height (*a*) of the frictional drag means 34 must be less than the distance of the inside dimension of the ribbon cartridge 10 from the bottom cover portion to top cover portion, otherwise the frictional drag means will bind against the bottom or top cover portion, or both, and not fold or bend with the movement of the ribbon. The thickness or height (*a*) of the frictional drag means 34 must not be too low in value or the ribbon 18 will tend to climb or ride over the end 35 and onto the top or bottom portion of the frictional drag means, thereby causing loss of tension control. Preferably the height (*a*) of the frictional drag means 34 will be just enough less than the inside dimension of the ribbon cartridge 10 so the frictional drag means will not bind on the top or bottom cover portions.

The length (*b*) of the frictional drag means 34 must be less than a value, which would cause end 35 to contact the side wall 38 of the ribbon cartridge 10, which connects the bottom cover portion and the top cover portion. There must be sufficient clearance between the end 35 and the side wall 38 of the ribbon cartridge 10 such that the ribbon 18 and/or the end 35 does not make contact with the side wall 38. The frictional drag means 34 must not be so short in length that it does not fold or bend with the movement of the ribbon; therefore, it is preferable to have the length as great as possible without causing the frictional drag means or the ribbon 18 to contact the side wall 38 and thereby cause binding of the ribbon and undue tension, etc., therein.

The frictional drag means 34 comprises a single item, which is simple in construction and inexpensive in cost. Drag means 34 is easily and quickly assembled into the ribbon cartridge 10 by hand or machine by aligning projections 32 and 33 with holes 36 and 37 and applying a slight downward pressure.

It is, therefore, evident that there has been provided in accordance with this invention a print wheel, which fully satisfies the objects, aims and advantages set forth above.

Although the present invention has been described with reference to a presently preferred embodiment, it will be appreciated by those skilled in the art that various modifications, alternatives, variations, etc., may be made without departing from the spirit and scope of the invention as defined in the appended claims. For example, the frictional drag means could take the shape of the letter T positioned on its side in the ribbon cartridge 10 of FIG. 2 with the ribbon 18 positioned along the top edge of the T.

What is claimed is:

1. In a ribbon cartridge having a top cover section, a bottom cover section, a sidewall connecting section, a ribbon supply means, a ribbon take-up means and means for transferring a ribbon between said supply means and said take-up means; the improved ribbon tension control means comprising:

a resilient one-piece frictional drag means positioned at a location along the path of travel of the ribbon after the ribbon departs from the ribbon supply means, said drag means including a first end portion stationarily mounted to the bottom cover section and a second end portion whose cross sectional end area abuts against the side surface of the ribbon, said drag means being formed of a material with a substantially constant coefficient of friction and being resiliently responsive to variations in ribbon tension resulting from operation of said ribbon take-up means so as to yieldably bias the ribbon in a direction opposite to the movement of the ribbon past the drag means, ribbon guide means positioned between said one-piece frictional drag means and said ribbon supply means for maintaining a substantially constant angle of contact between the one-piece frictional drag means and the ribbon.

2. The improvement of claim 1 wherein said stationary mounting comprises at least two rod members projecting from the bottom cover section and being of a size and location to cooperate with a like number of corresponding holes in the frictional drag means.

3. The improvement of claim 1 wherein said ribbon guide means comprises a single rod member projecting from the bottom cover section.

4. The improvement of claim 1 wherein said frictional drag means is formed of a polyester foam material.

5. The improvement of claim 1 wherein said frictional drag means is in the shape of a rectangular bar.

6. The improvement of claim 1 wherein the height of the frictional drag means is of a value to extend from the bottom cover section to the top cover section without binding on either section when the frictional drag means yieldably biases the ribbon.

* * * * *